US008794154B2

(12) United States Patent
Rotkopf

(10) Patent No.: US 8,794,154 B2
(45) Date of Patent: Aug. 5, 2014

(54) ARTILLERY PROJECTILE WITH SEPARATELY CONTROLLED BOOSTER ACTUATION AND FRAGMENT DISPERSION

(75) Inventor: Menachem Rotkopf, Haifa (IL)

(73) Assignee: Rafael Advanced Defense Systems Ltd., Haifa (IL)

( * ) Notice: Subject to any disclaimer, the term of this patent is extended or adjusted under 35 U.S.C. 154(b) by 251 days.

(21) Appl. No.: 13/054,502

(22) PCT Filed: Oct. 15, 2009

(86) PCT No.: PCT/IB2009/054540

§ 371 (c)(1),
(2), (4) Date: Jan. 17, 2011

(87) PCT Pub. No.: WO2010/049838

PCT Pub. Date: May 6, 2010

(65) Prior Publication Data

US 2011/0120337 A1 May 26, 2011

(30) Foreign Application Priority Data

Oct. 30, 2008 (IL) ..... 195003

(51) Int. Cl.
*F42B 15/10* (2006.01)
*F42B 12/64* (2006.01)

(52) U.S. Cl.
CPC ..... *F42B 12/64* (2013.01)
USPC ..... 102/379; 102/389; 102/393; 102/506; 102/494

(58) Field of Classification Search
USPC ..... 102/379, 384, 389, 393, 438, 489, 494, 102/506
See application file for complete search history.

(56) References Cited

U.S. PATENT DOCUMENTS

| | | | | |
|---|---|---|---|---|
| 3,903,804 | A | 9/1975 | Luttrell et al. | |
| 4,388,869 | A * | 6/1983 | Edleson | 102/494 |
| 4,638,737 | A * | 1/1987 | McIngvale | 102/489 |
| 4,922,826 | A | 5/1990 | Busch et al. | |
| 6,254,031 | B1 * | 7/2001 | Mayersak | 244/3.22 |
| 6,276,277 | B1 * | 8/2001 | Schmacker | 102/384 |
| 6,478,250 | B1 | 11/2002 | Adams et al. | |
| 6,540,175 | B1 * | 4/2003 | Mayersak et al. | 244/3.15 |
| 8,196,514 | B2 * | 6/2012 | Gustafsson et al. | 102/489 |
| 2006/0107862 | A1 | 5/2006 | Davis et al. | |
| 2007/0006766 | A1 | 1/2007 | Kellner | |

FOREIGN PATENT DOCUMENTS

SE WO2005068930 7/2005

* cited by examiner

*Primary Examiner* — Daniel J Troy
(74) *Attorney, Agent, or Firm* — Mark M. Friedman

(57) ABSTRACT

An artillery projectile for firing from an artillery gun, mortar or artillery rocket launcher. The artillery projectile includes a body, a payload with a number of inert fragments located within the body, a booster motor associated with the body for accelerating the body with the payload to a penetration velocity, and an opening arrangement associated with the body and deployed for initiating release of the fragments. The artillery projectile further includes a control system causally associated with the booster motor and the opening arrangement. The control system is configured to generate a first command to actuate the booster motor and a second command to actuate the opening arrangement.

16 Claims, 5 Drawing Sheets

ARTILLERY PROJECTILE WITH SEPARATELY CONTROLLED BOOSTER ACTUATION AND FRAGMENT DISPERSION

FIELD AND BACKGROUND OF THE INVENTION

The present invention relates to artillery projectiles for firing from indirect fire artillery pieces such as artillery guns, mortars and rocket artillery. In particular, it concerns an artillery projectile with separately controlled booster actuation and fragment dispersion arrangements, as well as systems and methods operating such projectiles.

Traditional warheads for artillery projectiles consist essentially of a metal envelope of a thickness sufficient to withstand launch acceleration, filled with a high-explosive charge. As this type of classical warhead has a very limited radius of effectiveness, cargo projectiles have been developed, containing a multitude of small bomblets, each bomblet including an envelope and explosive filler. The cargo warhead is opened as the projectile approaches the target area and the bomblets are dispersed over a large area. The bomblets are detonated upon ground impact and the area is covered by fragmentation generated from the individual bomblets.

While the fragmentation area of the cargo warhead is considerably larger than the one of the unitary projectile warhead, it has a major draw-back: unexploded bomblets pose a serious hazard of death or injury to friendly forces or to civilians that may later enter the coverage area, even a long time after cessation of the hostilities. Although such hazard may be mitigated by providing the individual bomblets with self-destruct mechanisms, such mechanisms have a certain degree of un-reliability and therefore the hazard to friendly forces and civilians is only mitigated but not totally negated.

As an alternative to explosive bomblets, it is possible to employ a cargo warhead carrying inert fragments which cause target damage by kinetic impact alone. In order to be effective, such warheads must generate a hail of high velocity fragments with a sufficient energy to penetrate the intended target. A booster motor is typically provided for this purpose. An example of such a system may be found in U.S. Pat. No. 4,922,826 to Busch et al. (although the Busch et al. document also discusses adding secondary incendiary compositions to the fragments).

Actuation of the booster motor generally also initiates, directly or indirectly, a dispersion mechanism which spreads the fragments over a large area perpendicular to the direction of flight, thereby generating wide area coverage of the target region. In the case of the aforementioned Busch et al. document, a booster motor accelerates and spins each warhead, and an ejection charge is detonated at the end of burning of the booster motor to expel the fragments from the warhead. Timing of the booster and the dispersion mechanism are interdependent, occurring in a fixed time sequence.

A critical factor in operation of inert-fragment cargo warheads is the timing and mechanism of dispersion. If fragments are dispersed too widely, typically due to early triggering of dispersion, the warhead will fail to provide saturation coverage of the targeted area. If on the other hand insufficient dispersion is achieved, typically due to late triggering of dispersion, only part of the targeted area will be hit. Thus, in planning a trajectory of the warhead, the required timing for triggering dispersion typically determines, working backwards, the time and position at which the booster must be actuated. This in turn dictates the trajectory which must be used to bring the warhead to the correct position and attitude for actuating the booster.

It would be advantageous to provide an artillery projectile with separately controlled booster actuation and fragment dispersion arrangements, as well as systems and methods operating such projectiles.

SUMMARY OF THE INVENTION

The present invention is an artillery projectile for firing from an artillery gun, mortar or rocket artillery, and corresponding systems and methods for operating such projectiles.

According to the teachings of the present invention there is provided, an artillery projectile for firing from an artillery gun, mortar or artillery rocket launcher, the artillery projectile comprising: (a) a body; (b) a payload including a plurality of inert fragments located within the body; (c) a booster motor associated with the body for accelerating the body with the payload to a penetration velocity; (d) an opening arrangement associated with the body and deployed for initiating release of the fragments; and (e) a control system causally associated with the booster motor and the opening arrangement, the control system being configured to generate a first command to actuate the booster motor and a second command to actuate the opening arrangement.

According to a further feature of the present invention, the inert fragments have an aspect ratio greater than 3:1.

According to a further feature of the present invention, the inert fragments are selected from the group consisting of metal rods and metal darts.

According to a further feature of the present invention, the opening arrangement includes an actuator deployed to disperse the inert fragments in a direction perpendicular to a direction of flight of the body.

According to a further feature of the present invention, the body is a roll-stabilized body, and wherein the opening arrangement includes an actuator deployed to release a retaining structure preventing dispersion of the inert fragments.

According to a further feature of the present invention, the opening arrangement includes a roll-generating pyrotechnic motor.

According to a further feature of the present invention, the control system includes a data storage device storing at least one parameter, and wherein a time between actuation of the booster motor and actuation of the opening arrangement is determined at least in part by a value of the at least one parameter.

According to a further feature of the present invention, the control system is configured to allow independent setting of a time for generating the first command and a time for generating the second command.

According to a further feature of the present invention, the control system is configured to allow setting, during flight of the shell, of a time for generating at least one of the first command and the second command.

According to a further feature of the present invention, the control system is located within the body.

According to a further feature of the present invention, the control system includes: (a) a communications device located within the body; and (b) at least one processor unit in communication with the communications device and housed separately from the body.

There is also provided according to the teachings of the present invention, a system for correcting flight of an artillery projectile to a target comprising: (a) the aforementioned artillery projectile; and (b) a trajectory monitoring arrangement deployed to monitor the trajectory of the artillery projectile in flight, wherein the control system is in data communication with the trajectory monitoring arrangement, and wherein the control system is configured: (i) to store at least one parameter defining a planned time of generation of the first command; (ii) to process data from the trajectory monitoring arrangement to assess a ranging inaccuracy; and (iii) to adjust the time of generation of the first command to reduce the ranging inaccuracy.

According to a further feature of the present invention, the control system is further configured to determine a time for generation of the second command as a function of at least the adjusted time of generation of the first command.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is an artillery projectile for firing from an artillery gun, mortar or rocket artillery, and corresponding systems and methods for operating such projectiles.

The principles and operation of artillery projectiles according to the present invention may be better understood with reference to the drawings and the accompanying description.

Figure 1:
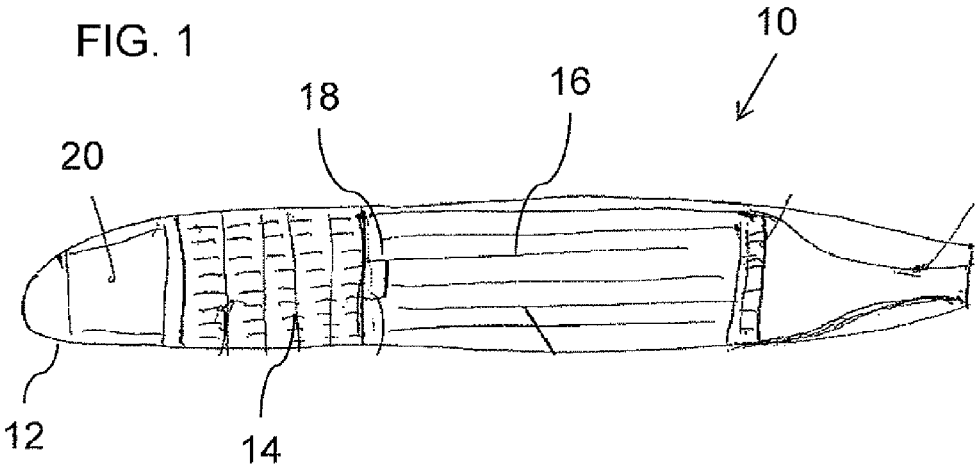
FIG. 1 is a schematic representation of an artillery projectile, constructed and operative according to the teachings of the present invention, including a booster motor and a fragment dispersion arrangement which are independently controlled.
Figure 2A:
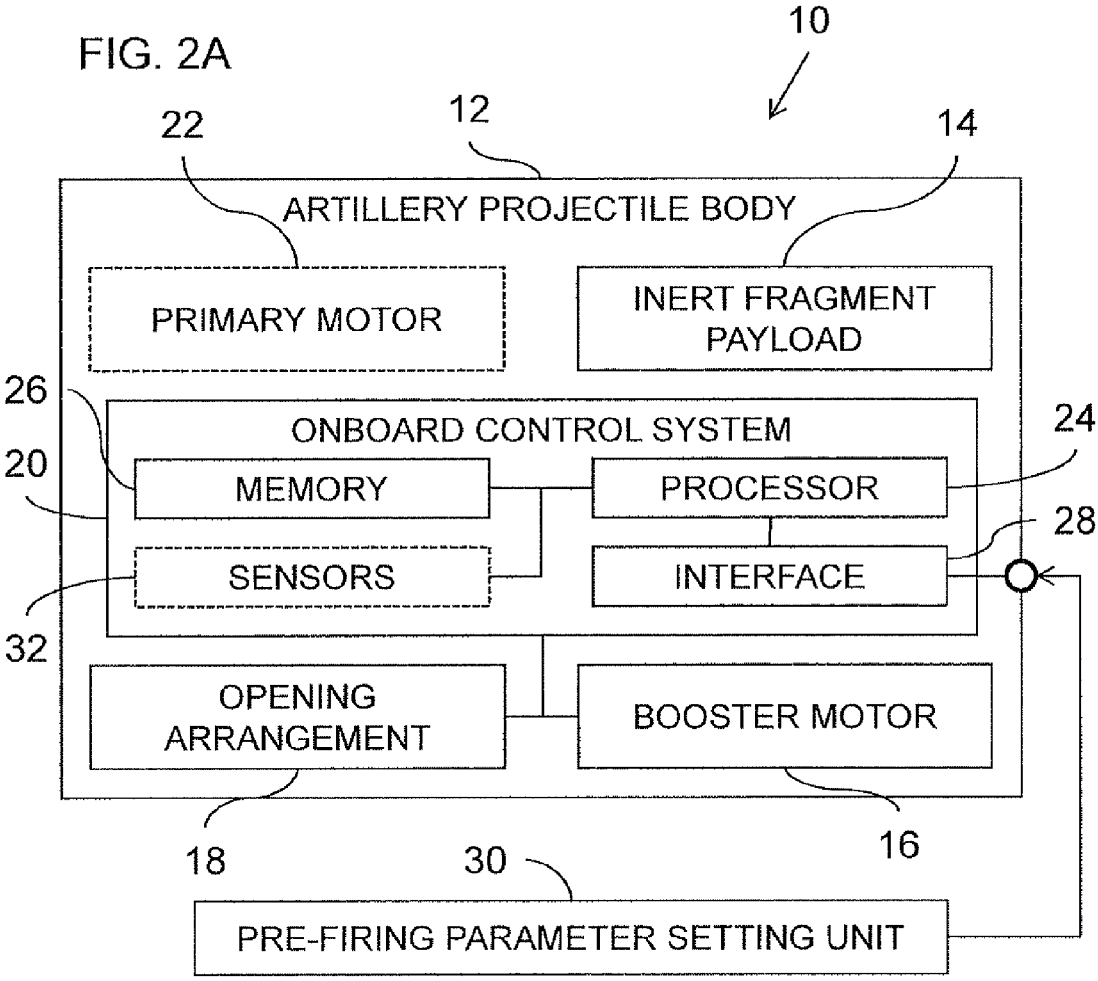
FIG. 2A is a schematic block diagram of a system employing the artillery projectile of FIG. 1 according to a first control architecture.
Figure 2B:
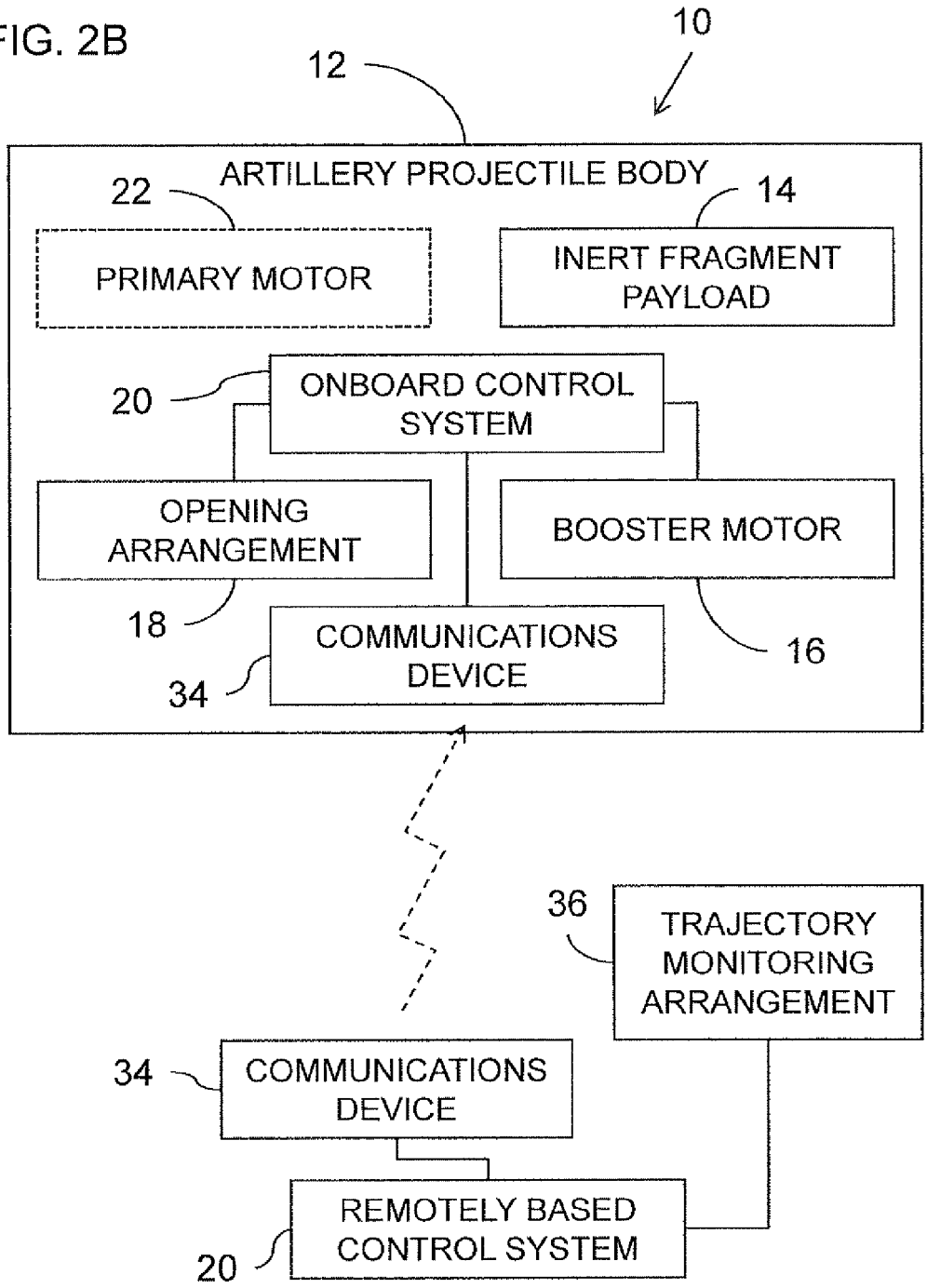
FIG. 2B is a schematic block diagram of a system employing the artillery projectile of FIG. 1 according to a second control architecture.

Referring now to the drawings, FIGS. 1, 2A and 2B illustrate an artillery projectile, generally designated 10, constructed and operative according to the teachings of the present invention, for firing from an artillery gun or mortar. Generally speaking, artillery projectile 10 has a body 12 which carries a cargo warhead with a payload including a plurality of inert fragments 14. A booster motor 16 is associated with body 12 and configured for accelerating body 12 with the payload to a penetration velocity. An opening arrangement 18 is associated with body 12 and deployed to initiate release of fragments 14. A control system 20, which may be self contained within body 12 as shown in FIG. 2A or implemented at least in part as a remote system 20' as shown in FIG. 2B, is causally associated with booster motor 16 and opening arrangement 18. Control system 20 is configured to generate a first command to actuate booster motor 16 and a second command to actuate opening arrangement 18, thereby providing individual control over the relative timing of booster actuation and the dispersion of fragments.

At this stage, it will be helpful to define certain terminology as is used herein in the description and claims. Firstly, the present invention is described as relating to artillery projectiles fired from artillery guns or mortars. In particular, the invention relates to "indirect fire" weapons, i.e., where the artillery projectile is fired along a relatively steep trajectory which is typically determined by calculation rather than by aligning a sight with the target.

The term "artillery projectile" as used herein in the description and claims refers to an unguided projectile suitable for firing from an artillery gun, from a mortar or from rocket artillery. The artillery projectile may be a shell initially associated with a cartridge (not shown) which contains propellant for firing the shell from a barrel, may be a shell fired by a propellant charge external to the artillery projectile, or may be an artillery rocket propelled by a primary rocket motor 22 (shown as an optional component in FIGS. 2A and 2B), all as is well known in the art. The artillery projectile may fly as a passive ballistic projectile along most of its trajectory, with or without an additional cruise motor to provide extended range, or in the case of an artillery rocket, flies as a ballistic rocket. The artillery projectile may be spin stabilized in flight, or may be fin stabilized. It will be noted that the various different implementations may have various additional structural features not shown here, each according to the type of projectile and the device used for firing the projectile. For example, a fin stabilized artillery rocket will typically include a set of folding fins and a fin opening mechanism, all as will be clear to one ordinarily skilled in the art. Such details are not considered relevant to the primary novelty of the present invention, and are therefore not addressed here in detail.

The term "booster" or "booster motor" is used to refer to a rocket motor configured to accelerate the body of the artillery projectile during the terminal portion of its flight to achieve a desired penetration velocity prior to dispersing fragments 14.

The term "opening arrangement" is used broadly to refer to any device or arrangement which can be actuated to directly or indirectly cause opening of the artillery projectile body and dispersion of the fragments. The term thus defined includes various mechanisms for directly opening, releasing or breaching the part of the artillery projectile enclosing the fragments, with or without an active dispersion mechanism. The term also encompasses various arrangements which indirectly cause opening and dispersion of the fragments, such as a torque generating rocket motor which generates sufficient angular momentum to cause the fragments to themselves break through the retaining structure around them. In all cases, it should be noted that the "opening arrangement" is configured to allow separately controlled timing, at least within some compatible range of times, relative to the actuation of the booster motor. Furthermore, it should be noted that any active dispersion of the fragments generated by the opening mechanism operates primarily in a direction perpendicular to the direction of flight of the artillery projectile, and is not the primary contribution to the impact energy of the fragments against the target.

Reference is made to one or more parameter which determines at least in part a time between actuation of the booster motor and actuation of the opening arrangement. This parameter or combination of parameters may directly correspond to a time from launch or an altitude, or may be part of a more complex expression from which one, other or both of the mentioned times are derived. The timing of actuation of the booster motor and actuation of the opening arrangement are described as being independently settable in the sense that setting of one value does not automatically determine the other. Clearly, practical limitations, such as the need to complete sufficient acceleration of the projectile before releasing the fragments, may dictate certain limitations on the range of values for one value based on the other, but this does not contradict the statement that the values are "independently settable" as defined herein.

The term "inert fragment" is used to refer to any fragment of material which does not include an explosive charge. Depending on the type of targets to be attacked, the fragments may have various sizes and various shapes, including but not limited to balls, cubes or elongated fragments. There are particular advantages to the use of elongated fragments, for example with an aspect ratio (length to width) of at least 3:1, so that the fragments are less affected by aerodynamic drag as they fly through the air. Preferred examples include rods, and most preferably, aerodynamically stabilized darts.

The terms "target" and "target region" or the like are used interchangeably to refer to the region over which the fragments are intended to impinge. The shape of the region in which the fragments impinge is typically roughly elliptical. For the purpose of discussion herein, a dimension of spread $D_s$ of the fragments is taken to be the extent of the region in which the fragments hit on level ground as measured in the plane of the trajectory of flight, i.e., the spread between fragments of minimum range and maximum range. An average radius of spread may be taken as half of this dimension. A "point of impact" is assumed to be the point at which the artillery projectile would have impacted the ground had the opening arrangement not been operated. During practical use of the artillery projectile of the present invention, it may be desirable to aim the artillery projectile so that the geometrical center of the fragment spread is centered in the target region. Nevertheless, for simplicity of presentation below, the "range" of the artillery projectile will be defined within this document as the distance from the point of firing to the point of impact.

As mentioned above, the ignition of the booster motor and the opening of the cargo warhead are conducted upon two separate, independent commands. The choice of the timing of the two events (booster actuation time $t_b$ and opening time $t_o$, respectively) determines, for a given launch angle $\theta_{launch}$, two important parameters:

a. The theoretical point of impact) $X_{impact}$, which is in fact the point around which the impact points of the individual fragments are dispersed.

b. The velocity of the projectile at the time of the opening of the cargo warhead.

This velocity, along with the height of opening, and along with the dispersion mechanism (such as rotation) and also along with the type of fragments contained in the cargo warhead, will determine the dimensions of the dispersal pattern $R_{average}$ and the velocity at impact $V_{impact}$. As the type of fragments might vary for several types of cargo warheads that might be mounted on the same type of projectile, and also as the required dimensions of the dispersal pattern may vary according to the type of fragments and due to tactical reasons, the ability to choose the velocity at the time of opening is a very important feature. In addition, the choice of the impact velocity is also important due to terminal ballistic effectiveness considerations, which are based on fragment characteristics (type, mass, velocity on one hand) and target characteristics. Specifying lethality criteria for various threats versus various targets is a matter well-known for those familiar in the art of terminal ballistics.

Figure 3:
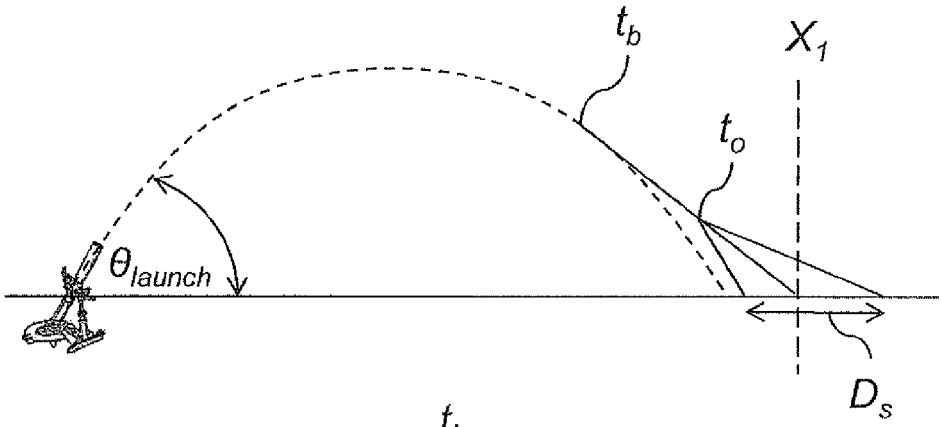
FIG. 3 is a schematic representation of the trajectory and operation of the artillery projectile of FIG. 1 from firing through booster actuation and fragment dispersion to impinging on a target region.

FIG. 3 depicts the geometric and kinematic parameters related to firing the projectile. As mentioned, for a given type of fragments contained in the cargo warhead, one can select the desired point of impact $X_{impact}$, desired dimension of spread $D_s$ of the dispersion pattern and the desired impact velocity $V_{impact}$ by the proper choice of three independent parameters (launch angle $\theta_{launch}$, booster ignition time $t_b$, and dispenser opening time $t_o$).

The projectile is launched by an artillery launching system, such as a mortar, artillery rocket launcher or cannon. Prior to launch, the elevation angle is determined and activation settings are preferably provided to the projectile. The settings include the preferred altitude of warhead opening (either expressed as altitude or as the corresponding time pre-calculated for the estimated trajectory), the time or altitude of activating a rotation means (such as a propulsive torque motor, pre-calculated for the estimated trajectory) and the nominal time or altitude of the booster motor ignition pre-calculated for the estimated trajectory. The settings may be provided as altitudes rather than time data if the projectile is equipped with means of altitude measurement such as an altimeter or as a GPS system.

As a matter of definition, a nominal trajectory of the projectile is a trajectory that corresponds to a projectile of nominal physical characteristics and without any disturbances during launch and flight. For a nominal trajectory at a given launch angle, there is in general a one-to-one functional dependence between "time" and "height" when referred along any point along the trajectory, that is to say that there is a time for each height (or in fact two times if one considers both ascending and descending portions of the trajectory). Due to such functional dependence, wherever reference is made in this specification and the appended claims to the timing of any event, such reference should be construed in the broader sense to encompass the possibility of the timing being defined in terms of height and vice-versa.

Figure 4A:
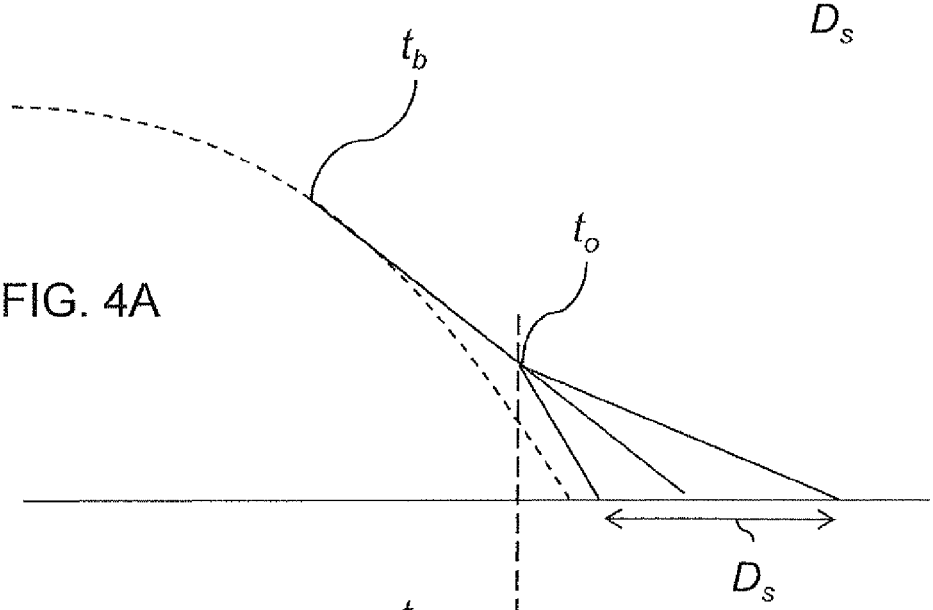
FIGS. 4A and 4B are enlarged views of a latter part of the trajectory of FIG. 3 showing the effect of later and earlier timing, respectively, for opening of the fragment dispersion arrangement.
Figure 4B:
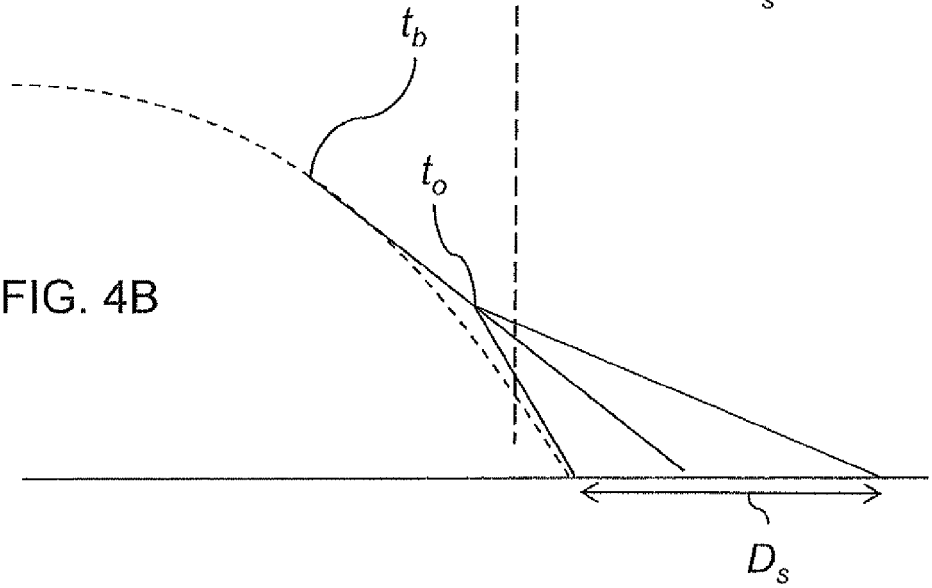

The effects of varying each of the boost motor actuation time and the fragment dispersion opening time are illustrated intuitively in FIGS. 4A-4B and 5A-5C. Specifically, FIGS. 4A and 4B illustrate for a given $t_b$ the effect of retarding and advancing $t_o$. For a given boost actuation time and incident angle, a relatively retarded opening time for dispersing fragments as illustrated in FIG. 4A results in a denser distribution of fragments with a smaller dimension of spreading $D_s$, whereas a relatively advanced opening time as illustrated in FIG. 4B results in a wider distribution with a larger dimension of spreading $D_s$.

Figure 5A:
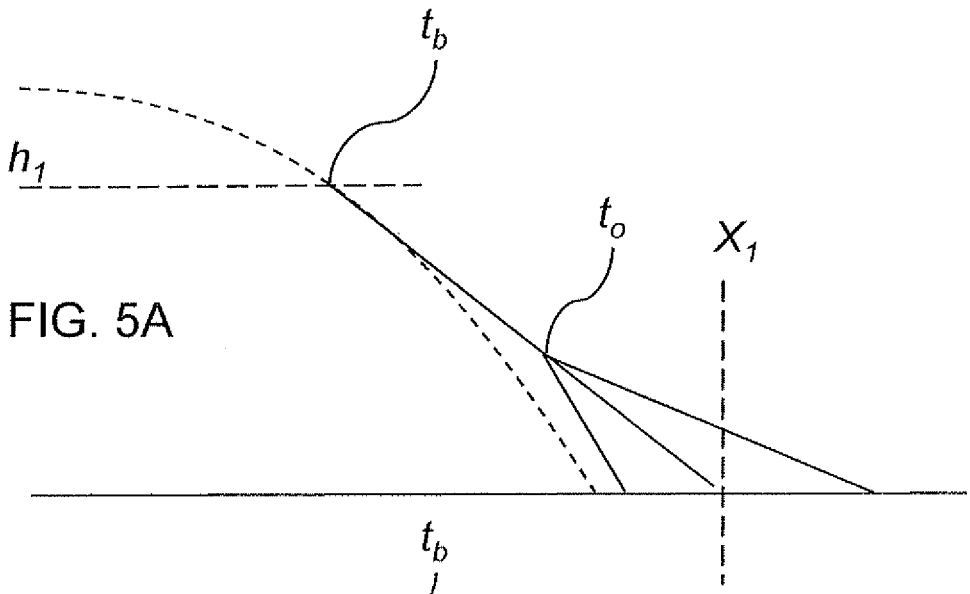
FIGS. 5A-5C are enlarged views of a latter part of the trajectory of FIG. 3 showing the effect on range of "normal", advanced and retarded actuation of the booster motor, respectively.
Figure 5B:
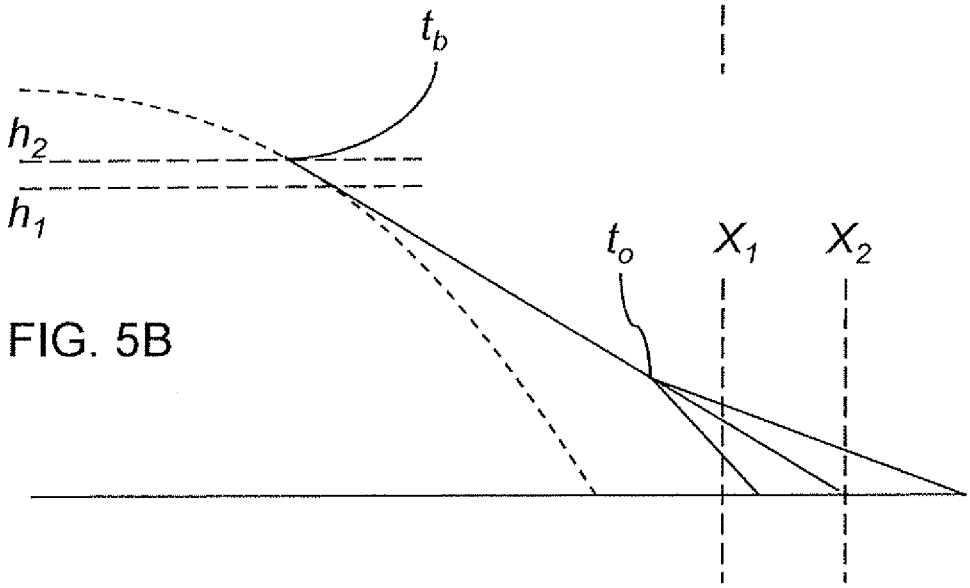
Figure 5C:
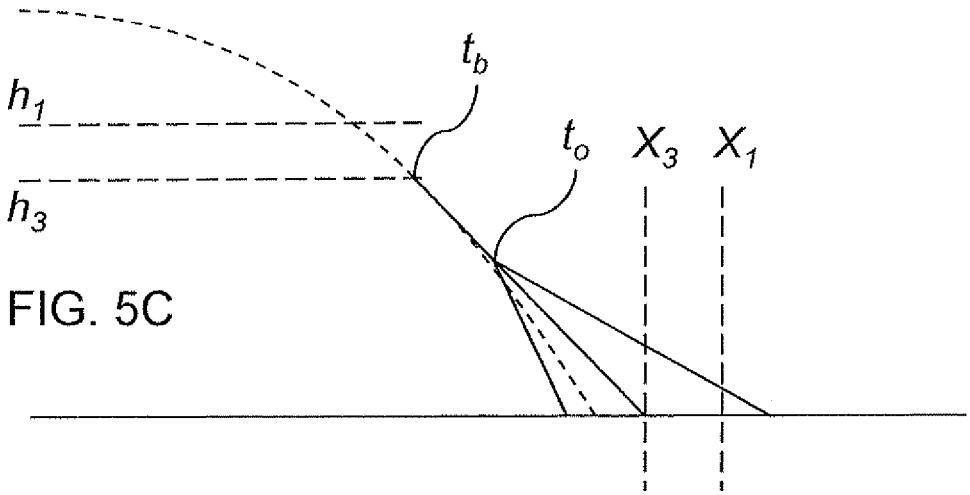

FIGS. 5A-5C illustrate the effect of retarding and advancing booster actuation time $t_b$. It will be noted that the effect of actuating booster motor 16 is to deviate from the curved ballistic path followed by the artillery projectile prior to that point, following a different ballistic path which, on the scale illustrated here, may be approximated by a straight line in the direction in which the artillery projectile was pointing when the motor was actuated. It follows that, by retarding or advancing the moment of booster actuation, it is possible to affect the subsequent path of the artillery projectile, and hence for example to vary the range of the artillery projectile. Thus, in FIG. 5A, the booster motor is actuated at $t_b$ corresponding to a height $h_1$ which results in a point of impact at range $X_1$. In FIG. 5B, $t_b$ is advanced to an earlier time corresponding to a higher altitude $h_2$, resulting in an increase in the range to $X_2$. FIG. 5C on the other hand shows the effect of retarding booster actuation to a later time $t_b$ corresponding to a lower altitude $h_3$. In this case, the range is shortened to $X_3$ as shown.

In practice, according to certain preferred embodiments, the aforementioned capability to vary the range may be used during flight to correct for errors. If it is determined during flight that the projectile is "short in range" or "long in range", the ignition of the rocket motor can be shifted from the pre-calculated point by a specific interval, calculated to compensate the predicted range deviation. An actual trajectory might deviate from the pre-calculated trajectory due to several reasons, for example deviations in projectile weight, deviation in launch velocity, atmospheric conditions different than those employed when calculating the pre-calculated trajectory (winds, temperature). The deviation of a trajectory from the pre-calculated trajectory is detectable and quantifiable with the use of on-board sensors, such as GPS and/or inertial sensors, or may be determined by an external trajectory monitoring system, such as a radar system. The data of the pre-calculated trajectory are fed to the on-board processor. By performing variations relative to the pre-calculated trajectory (for example by making corrections to replace the launch velocity assumed in the pre-calculated trajectory with an actual measured launch velocity), a corrected trajectory may be estimated by the processor. Along such corrected trajectory, the timing of booster ignition and the timing of the warhead dispersion may be varied in order to compensate for foreseeable deviations in the impact conditions. For example, if the corrected trajectory is deemed to be "short" or "long", the booster motor is ignited earlier than nominal or later than nominal, respectively, thereby compensating for the range deviation. Thus, impact accuracy in range can be improved. One may vary both the ignition time of the flight motor and the opening time of the dispenser and by a proper choice of a pair of these parameters, reach a desired impact point with a desired velocity and spread of fragments.

Parenthetically, it should be noted that the ability to affect the range of the artillery projectile in this manner does not contradict the definition of the artillery projectile as "unguided," since the artillery projectile does not have any steering mechanism and the variation in range is achieved by controlling timing of the axial thrust vector.

Figure 6:
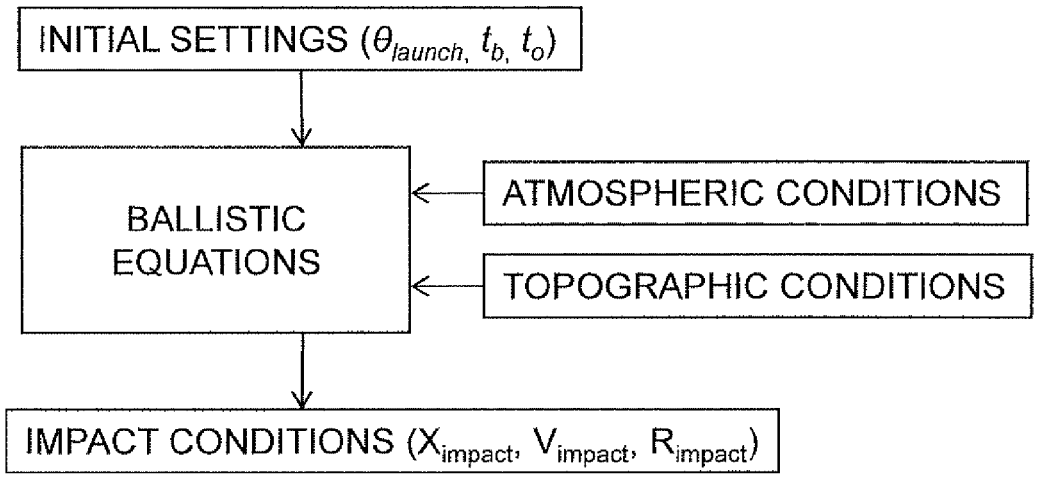
FIG. 6 is a flow diagram of direct ballistic calculations modeling the operation of the artillery projectile of the present invention.
Figure 7:
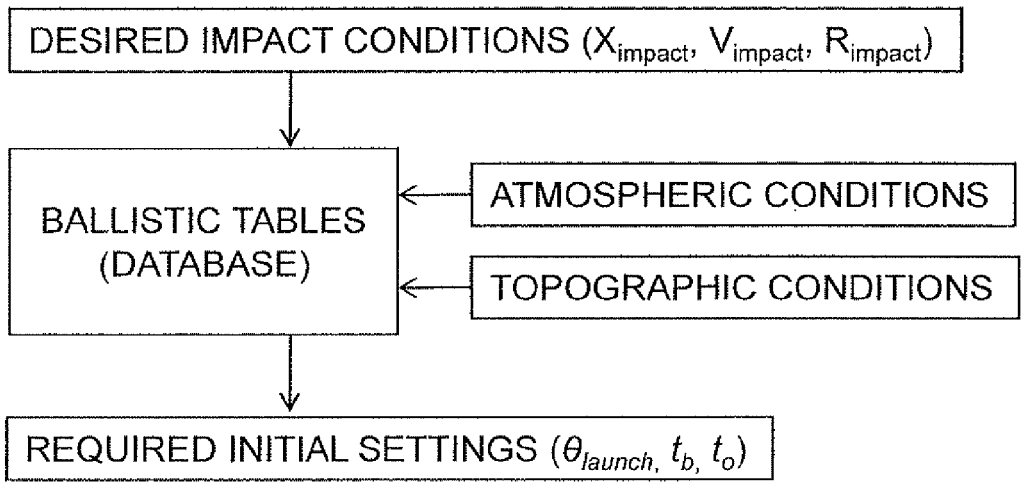
FIG. 7 is a flow diagram of inverse ballistic calculations employed to derive initial parameters or corrected parameters for operating the artillery projectile of the present invention.

Turning now to FIGS. 6 and 7, these illustrate schematically possible flow-charts for determining the parameters to be set prior to launch. For any artillery system, ballistic tables may be calculated by using the equations of motion and the known physical characteristics of the projectile. Such tables, rendering the impact conditions as a function of the initial settings, are well known for those skilled in the art of artillery. These tables are prepared for a multitude of nominal launch conditions and also include estimates of the influences of variations in the atmospheric conditions (temperature, wind, launch altitude) and topographic conditions (difference between launch altitude and target altitude). FIG. 6 presents the direct calculation method, which is the basis for preparation of the ballistic tables. The tables may be produced in the form of extensive computerized databases.

FIG. 7 presents the inverse ballistic problem, which includes look-up in the ballistic tables for settings corresponding to the desired impact conditions. This may be conducted by an iterative computer program that will search the firing table database iteratively for the combination of settings rendering the desired impact conditions. Methods of preparing firing tables and iterating therein are well-known to those skilled in the art of artillery and are presented, for example, in U.S. Pat. No. 4,568,823.

Booster motor 16 is needed to provide the projectile additional kinetic energy, in order to bring fragments 14 to a velocity sufficient to impact the target according to lethality criteria. The lethality criteria for various targets are well known for those familiar with the art of terminal ballistics. In general, the time of ignition of the booster motor is ahead of the time of opening the warhead for dispersing the cargo by at least the burning time of the rocket motor, but preferably by a longer time interval. Booster motor 16 is activated in response to an actuation command from control system 20 by an igniter (not shown in the Figure), as is known in the art.

The cargo warhead is preferably essentially inert, with the possible exception of pyrotechnic actuators employed as part of opening arrangement 18. The opening arrangement 18 may include a fuze that activates several linear shaped-charge type cutting chords (not shown in the Figure). Pyrotechnic opening arrangements, for example as described in U.S. Pat. No. 3,968,748, are well known to those skilled in the art of cluster ammunition and therefore are not detailed in this specification.

To assist in dispersing fragments 14 over a large area upon opening the warhead envelope, a device may be provided to generate rotational velocity around the longitudinal axis, such as propulsive torque motors that will provide torque around the longitudinal axis. An example of a suitable propulsive torque motor may be found in U.S. Pat. No. 6,478,250. If the projectile is spin-stabilized, there may be no need for additional means of rotation.

Control system 20 preferably includes all the electronic circuitry, power sources, and interfaces necessary for inputting the various settings to the projectile and providing the commands for functioning of the various elements mentioned above (flight motor ignition, propulsive torque motor ignition, if applicable, activation of the warhead opening system). In the implementation illustrated in FIG. 2A, the entire control system 20 is located within artillery projectile 10. Thus, control system 20 as illustrated includes a processor 24 and a data storage device such as memory 26. In order to input the operational parameters prior to firing, control system 20 preferably also includes an interface 28 configured to allow electrical connection with an external pre-firing parameter setting unit 30.

In a simplest implementation, parameter setting unit 30 sets the timing for firing booster and actuating the opening arrangement in terms of elapsed time after firing. In this case, control system is typically responsive to the set-back of firing (for example, derived by connection to an arming circuit, not shown) to start timing the periods until firing booster 16 and actuating opening arrangement 18. Optionally, control system 20 may include other sensors 32, such as GPS sensors, an altimeter and/or inertial sensors, thereby allowing definition of the booster firing time $t_b$ and opening arrangement actuation $t_o$ in terms of altitude or position. Where such sensors are present, according to certain preferred implementations, this also enables comparison of the sensed flight parameters against the pre-firing estimated parameters. An in-flight correction can then be made to at least partially compensate for errors in range etc. by advancing or retarding the initiation of booster motor 16 (and complementary compensation by altering the actuation time of the opening mechanism to maintain the intended degree of fragment dispersion) according to the principles described above with reference to FIGS. 4A-4B and 5A-5C.

An alternative implementation is illustrated in FIG. 2B in which at least part of the control system is located remotely, typically in a ground-based system. Thus, FIG. 2B shows an onboard control system 20 and a remotely based control system 20' which cooperate to together provide the functionality of the present invention. One, other or both of control systems 20 and 20' may include some or all of the subcomponents shown in FIG. 2A, which are not detailed here for clarity of presentation. Control systems 20 and 20' communicate via a suitable communication devices 34, preferably via wireless communication, and most preferably via radio frequency (RF) electromagnetic waves according to any suitable communications standard. The use of a ground-based control system 20' allows operation of artillery projectile 10 to be integrated with other ground-based systems, or other networked sources of information. In one particularly preferred example as shown here, control system 20' is associated with a trajectory monitoring arrangement 36, typically in the form of a radar tracking system which tracks the actual trajectory of artillery projectile 10 during flight. This data can then be used for calculating a required in-flight correction to $t_b$ and $t_o$, which is uploaded via the communication devices 34 to the onboard control system 20 which implements the correction to the stored parameters. In some cases, the values of the parameters may be set for the first time during flight of the projectile. In either case, the process of setting or resetting/updating parameters is referred to generically as "setting".

It will be appreciated that the above descriptions are intended only to serve as examples, and that many other embodiments are possible within the scope of the present invention as defined in the appended claims.

What is claimed is:

1. An artillery projectile for firing from an artillery gun, mortar or artillery rocket launcher, the artillery projectile comprising:

(a) a body;

(b) a payload including a plurality of inert fragments located within said body;

(c) a booster rocket motor associated with said body for accelerating said body with said payload to a penetration velocity;

(d) an opening arrangement associated with said body and deployed for initiating release of said fragments; and (e) a control system causally associated with said booster rocket motor and said opening arrangement, said control system including a data storage device storing at least one parameter, said control system being configured to generate during a terminal portion of flight of the artillery projectile a first command to actuate said booster rocket motor and a second command to actuate said opening arrangement, wherein a time between actuation of said booster rocket motor and actuation of said opening arrangement is determined at least in part by a value of said at least one parameter.

2. The artillery projectile of claim 1, wherein said inert fragments have an aspect ratio greater than 3:1.

3. The artillery projectile of claim 1, wherein said inert fragments are selected from the group consisting of metal rods and metal darts.

4. The artillery projectile of claim 1, wherein said opening arrangement includes an actuator deployed to disperse said inert fragments in a direction perpendicular to a direction of flight of said body.

5. The artillery projectile of claim 1, wherein said body is a roll-stabilized body, and wherein said opening arrangement includes an actuator deployed to release a retaining structure preventing dispersion of said inert fragments.

6. The artillery projectile of claim 1, wherein said opening arrangement includes a roll-generating pyrotechnic motor.

7. The artillery projectile of claim 1, wherein said control system is configured to allow independent setting of a time for generating said first command and a time for generating said second command.

8. The artillery projectile of claim 1, wherein said control system is configured to allow setting, during flight of the shell, of a time for generating at least one of said first command and said second command.

9. The artillery projectile of claim 1, wherein said control system is located within said body.

10. The artillery projectile of claim 1, wherein said control system includes:

(a) a communications device located within said body; and (b) at least one processor unit in communication with said communications device and housed separately from said body.

11. A system for correcting flight of an artillery projectile to a target comprising:

(a) the artillery projectile of claim 1;

(b) a trajectory monitoring arrangement deployed to monitor the trajectory of said artillery projectile in flight, wherein said control system is in data communication with said trajectory monitoring arrangement, and wherein said control system is configured:

(i) to store at least one parameter defining a planned time of generation of said first command;

(ii) to process data from said trajectory monitoring arrangement to assess a ranging inaccuracy; and (iii) to adjust said time of generation of said first command to reduce said ranging inaccuracy.

12. The system of claim 11, wherein said control system is further configured to determine a time for generation of said second command as a function of at least the adjusted time of generation of said first command.

13. The artillery projectile of claim 1, including a propulsive torque motor deployed to generate rotational velocity around a longitudinal axis of the projectile.

14. The artillery projectile of claim 13, wherein said control system is additionally configured to actuate said propulsive torque motor.

15. A method for operating an artillery projectile comprising the steps of:

(a) providing the artillery projectile of claim 1;

(b) receiving a set of desired impact conditions including a range and a dimension of a dispersion pattern;

(c) deriving required settings including: a launch elevation, a first time for initiating said booster rocket motor and a second time for actuating said opening arrangement, said settings corresponding to the set of desired impact conditions;

(d) setting said control system so as to initiate said booster rocket motor at said first time and to actuate said opening arrangement at said second time; and (e) firing said artillery projectile at said launch elevation.

16. The method of claim 15, wherein said set of desired impact conditions includes an impact velocity.

* * * * *